US010641037B2

(12) United States Patent
Anderson

(10) Patent No.: US 10,641,037 B2
(45) Date of Patent: May 5, 2020

(54) CORD DRIVE ASSEMBLY FOR AN ARCHITECTURAL COVERING WITH A BRAKING MEMBER AND ASSOCIATED BIASING ELEMENT

(71) Applicant: Hunter Douglas, Inc., Pearl River, NY (US)

(72) Inventor: Richard N. Anderson, Whitesville, KY (US)

(73) Assignee: Hunter Douglas Inc., Pearl River, NY (US)

( * ) Notice: Subject to any disclaimer, the term of this patent is extended or adjusted under 35 U.S.C. 154(b) by 248 days.

(21) Appl. No.: 15/402,358

(22) Filed: Jan. 10, 2017

(65) Prior Publication Data

US 2017/0198520 A1 Jul. 13, 2017

Related U.S. Application Data

(60) Provisional application No. 62/277,638, filed on Jan. 12, 2016.

(51) Int. Cl.
*E06B 9/322* (2006.01)
*E06B 9/262* (2006.01)

(52) U.S. Cl.
CPC ..... *E06B 9/322* (2013.01); *E06B 9/262* (2013.01); *E06B 2009/2625* (2013.01); *E06B 2009/3222* (2013.01)

(58) Field of Classification Search
CPC .. E06B 9/322; E06B 9/262; E06B 2009/2625; E06B 2009/3222
See application file for complete search history.

(56) References Cited

U.S. PATENT DOCUMENTS 12,881 A * 5/1855 Webster ..... E06B 9/90 160/299
1,563,267 A * 11/1925 Eckermann ..... E06B 9/60 160/303
3,854,428 A * 12/1974 Fullenkamp ..... A47B 9/00 108/136
4,476,910 A * 10/1984 Saito ..... E06B 9/50 160/291

(Continued)

FOREIGN PATENT DOCUMENTS

EP 2060732 5/2009
WO WO 98/57026 12/1998

OTHER PUBLICATIONS

Dutch Patent Office Search Report dated Sep. 27, 2017, (9 Pages).

*Primary Examiner* — Katherine W Mitchell
*Assistant Examiner* — Abe Massad
(74) *Attorney, Agent, or Firm* — Dority & Manning, P.A.

(57) ABSTRACT

A cord drive assembly for raising a covering relative to an architectural structure may include a housing and at least one cord drive component mounted for rotation within the housing. Additionally, in one embodiment, the cord drive assembly may include a biasing element installed relative to the housing such that the biasing element applies a biasing force against a braking member of the cord drive assembly that biases the braking member against the cord drive component to hinder rotation of the cord drive component relative to a second cord drive component positioned within the housing.

24 Claims, 11 Drawing Sheets

(56) References Cited

U.S. PATENT DOCUMENTS

| | | | | | |
|---|---|---|---|---|---|
| 5,791,393 | A * | 8/1998 | Judkins | E06B 9/322 | 160/308 |
| 6,112,800 | A * | 9/2000 | Marusak | E06B 9/56 | 160/298 |
| 6,142,211 | A * | 11/2000 | Judkins | E06B 9/262 | 160/308 |
| 6,644,375 | B2 * | 11/2003 | Palmer | E06B 9/322 | 160/170 |
| 7,331,370 | B1 * | 2/2008 | Militello | E06B 9/322 | 160/170 |
| 9,314,125 | B2 * | 4/2016 | Anthony | A47H 5/032 | |
| 9,341,020 | B1 * | 5/2016 | Kao | E06B 9/262 | |
| 9,366,077 | B2 * | 6/2016 | Chen | F16H 31/001 | |
| 9,695,633 | B2 * | 7/2017 | Morris | E06B 9/262 | |
| 2009/0120592 | A1 | 5/2009 | Lesperance | | |
| 2009/0120593 | A1 | 5/2009 | Lesperance | | |
| 2011/0290429 | A1 * | 12/2011 | Cheng | E06B 9/262 | 160/84.02 |
| 2012/0048485 | A1 | 3/2012 | Fu-Lai | | |
| 2015/0028144 | A1 * | 1/2015 | Defenbaugh | E06B 9/322 | 242/378.4 |
| 2017/0211318 | A1 * | 7/2017 | Chen | E06B 9/322 | |
| 2017/0211320 | A1 * | 7/2017 | Chen | E06B 9/322 | |

* cited by examiner

CORD DRIVE ASSEMBLY FOR AN ARCHITECTURAL COVERING WITH A BRAKING MEMBER AND ASSOCIATED BIASING ELEMENT

CROSS-REFERENCE TO RELATED APPLICATIONS

The present application is based upon and claims priority to and the benefit of the filing date of U.S. Provisional Patent Application Ser. No. 62/277,638, filed on Jan. 12, 2016, and titled "Housing with Cantilevered Plastic Arm and Biasing Spring," the disclosure of which is hereby incorporated by reference herein in its entirety for all purposes.

FIELD OF THE INVENTION

The present subject matter relates generally to coverings for architectural structures and, more particularly, to a cord drive assembly having a braking member and associated biasing element for use with a covering for an architectural structure, such as a window.

BACKGROUND OF THE INVENTION

Various operating mechanisms are known that provide a cord drive for raising a covering, such as a Venetian blind or pleated shade, relative to an architectural structure (e.g., a window). Examples of such cord drives are disclosed in U.S. Patent Publication No. 2009/0120592, filed on Nov. 3, 2008, and U.S. Patent Publication No. 2009/0120593, filed on Jan. 16, 2009, the disclosures of both of which are hereby incorporated by reference herein in their entirety for all purposes. In embodiments of the operating mechanisms disclosed in such publications, the cord drive is housed in a plastic housing, and short strokes of a drive cord unwinding from a cord drum raise the covering. Additionally, a spring is used to rewind the cord onto the cord drum after each stroke and a Bendix-type mechanism is used to drive an output shaft in connection with each short cord stroke, with rotation of the output shaft raising the covering. When the cord is released, the drive is disengaged to allow the spring to rewind the drive cord onto the cord drum. Thereafter, when the user again pulls on the drive cord, the Bendix-type mechanism re-engages to rotate the output shaft in a manner that further raises the covering. This process is then repeated until the covering is raised to the desired position.

The Bendix-type mechanism typically includes axially-projecting gear teeth on an input member that is configured to move axially with each drive cord stroke to engage mating axially-projecting gear teeth on an output member of the mechanism in order to drive the output shaft. In addition, the Bendix-type mechanism typically includes a drive member that rotates with the cord spool. The drive member is configured to rotate relative to the input member until an axial projection on the drive member engages an internal face on the input member to rotate the input member and push such member axially to cause the input member to engage with and rotate the output member.

Such a cord drive arrangement requires that there be some amount friction on the input member to prevent rotation of the input member relative to the drive member until the axial projection of the drive member "catches up" to or otherwise engages the internal face on the input member to push it forward and provide the typical Bendix-type mechanism action. In prior art devices, this friction has been obtained by using a plastic arm on the housing that encases the cord drive. The plastic arm contacts the input member and acts as a spring, applying a small spring force to the input member to create friction between the plastic arm and the input member to prevent the input member from rotating with the drive member when it is not being positively driven by the drive member. Unfortunately, given that the plastic arm is held in a stressed condition for a very long period of time, the plastic material may cold flow over time, thereby reducing the spring force provided by the plastic arm such that the plastic arm no longer prevents the input member from rotating with the drive member when it is not being positively driven by the drive gear.

Accordingly, an improved cord drive assembly that allow for a more constant, reliable restraining or braking force to be applied to the input member of an associated Bendix-type mechanism of the cord drive assembly would be welcomed in the technology.

BRIEF DESCRIPTION OF THE INVENTION

Aspects and advantages of the present subject matter will be set forth in part in the following description, or may be obvious from the description, or may be learned through practice of the present subject matter.

In various aspects, the present subject matter is directed to a cord drive assembly for raising a covering relative to an architectural structure, such as a window. In one embodiment, the cord drive assembly includes a housing and at least one cord drive component mounted for rotation within the housing. Additionally, in one embodiment, the cord drive assembly includes a biasing element installed relative to the housing such that the biasing element applies a biasing force against a braking member of the cord drive assembly that biases the braking member against the cord drive component to hinder rotation of the cord drive component relative to a second cord drive component positioned within the housing.

These and other features, aspects and advantages of the present subject matter will become better understood with reference to the following Detailed Description and appended claims. The accompanying drawings, which are incorporated in and constitute a part of this specification, illustrate embodiments of the present subject matter and, together with the description, serve to explain the principles of the present subject matter.

This Brief Description is provided to introduce a selection of concepts in a simplified form that are further described below in the Detailed Description. This Brief Description is not intended to identify key features or essential features of the claimed subject matter, nor is it intended as an aid in determining the scope of the claimed subject matter.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which.

DETAILED DESCRIPTION OF THE INVENTION

Figure 1:
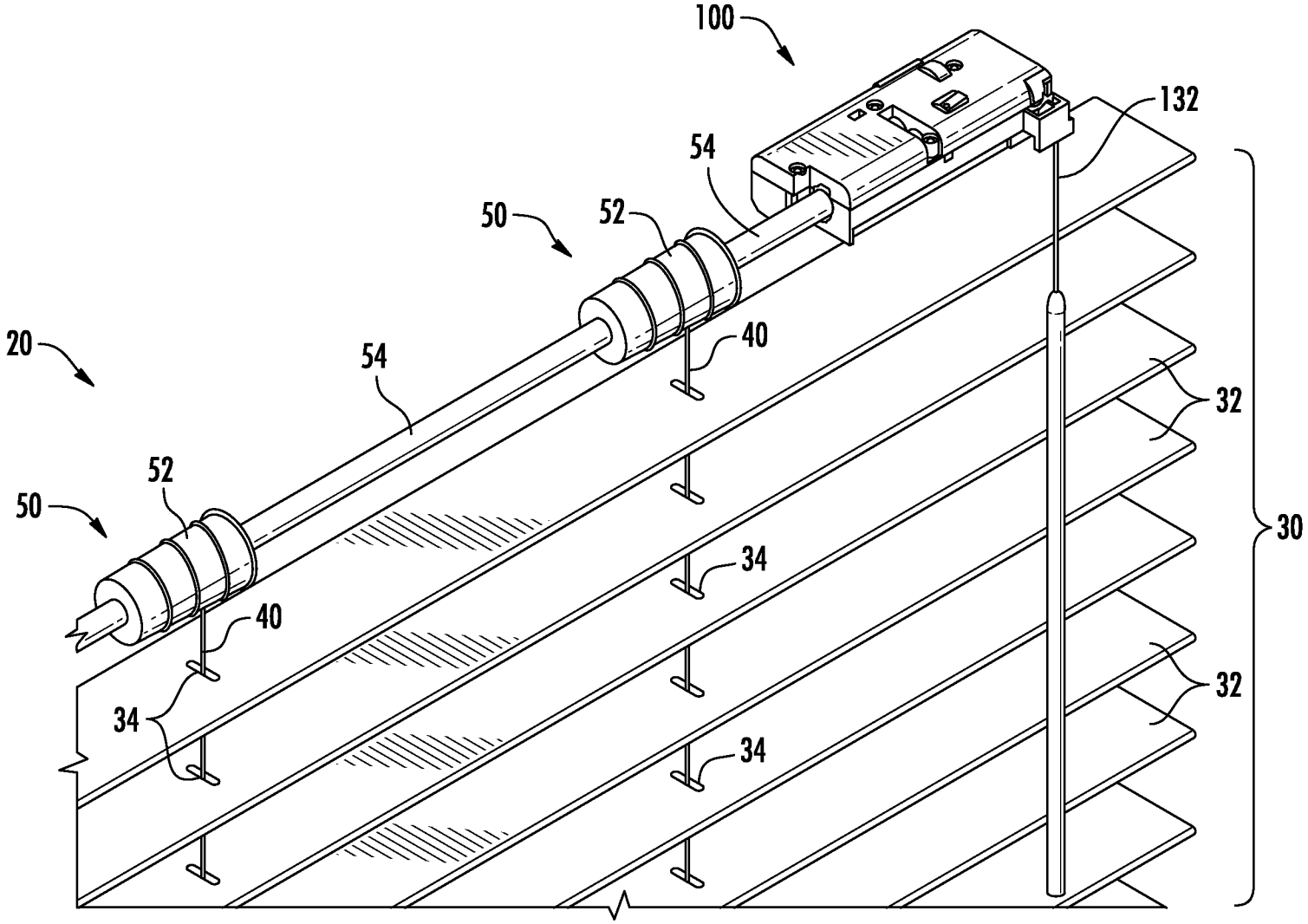
FIG. 1 illustrates a partial, perspective view of one illustrative embodiment of a covering for an architectural structure in accordance with aspects of the present subject matter, particularly illustrating the covering including a cord drive assembly.

In general, the present subject matter is directed to a cord drive assembly for raising a covering relative to an architectural structure, such as a window. In accordance with one aspect of this disclosure, which optionally is separate and independent from other aspects, the functioning and operation of a cord drive assembly is improved without altering (or at least without significantly altering) the structure of the operating elements of the cord drive assembly. Instead, in accordance with such aspect of this disclosure, the functioning and operation of a cord drive system is improved by altering the housing of the operating elements. Such alteration generally is less expensive than an alteration to the operating elements themselves. The alteration preferably results in smoother, consistent, and/or repeatable operation of the cord drive assembly.

In one embodiment, the cord drive assembly includes a housing and at least one cord drive component mounted for rotation within the housing. Additionally, in one embodiment, the cord drive assembly includes a biasing element installed relative to the housing such that the biasing element applies a biasing force against a braking member of the cord drive assembly to bias the braking member against the cord drive component to at least partially hinder rotation of the cord drive component within the housing.

In one embodiment, the biasing element corresponds to a spring provided in operative association with the braking member. For instance, the spring may be installed relative to the housing and/or the braking member such that a first portion of the spring is configured to be engaged against a portion of the braking member while a second portion of the spring is configured to be engaged against a portion of the housing. As such, when installed relative to the housing and the braking member, the spring may be configured to apply a biasing force against the braking member that biases the braking member against the cord drive component.

Additionally, in one embodiment, the braking member corresponds to a cantilevered arm of the housing. For example, the housing may define an opening within which the cantilevered arm extends. In such an embodiment, the biasing element may be configured to apply the biasing force against the cantilevered arm such that a distal or free end of the cantilevered arm is biased into engagement with the cord drive component to at least partially hinder rotation of such component within the housing.

In one embodiment, the cantilevered arm is formed integrally with the housing. For example, the cantilevered arm may be configured to extend lengthwise between its distal or free end and an opposed proximal end. In such an embodiment, the proximal end of the cantilevered arm may be formed integrally with the housing.

Moreover, in one embodiment, the cord drive component corresponds to an input member of a Bendix-type mechanism. For instance, the input member may be configured to be moved axially within the housing relative to a corresponding output member of the Bendix-type mechanism between a disengaged or first position and an engaged or second position. In such an embodiment, the input member may be rotationally decoupled from and spaced apart axially relative to the output member when the input member is moved to its disengaged or first position. Similarly, the input member may be rotationally coupled to and positioned adjacent to the output member when the input member is moved to its engaged or second position. In addition, in such an embodiment, the braking member may be configured to apply a braking or restraining force against the input member to at least partially inhibit or hinder its rotation within the housing.

Further, in one embodiment, the cord drive assembly includes a second cord drive component (e.g., a drive shaft) configured to rotate relative to the input member when the input member is located at its first position. In such an embodiment, a portion of the second cord drive component may be configured to contact a corresponding portion of the input member to push the input member axially relative to the output member from the first position to the second position. In addition, when the input member is located at its first position, the braking member may be configured to at least partially hinder rotation of the input member to allow the second cord drive component to rotate relative to the input member.

It should be appreciated that, although the present subject matter will generally be described herein with reference to applying a braking or restraining force to a rotatable component of a cord drive assembly configured for use with a covering for an architectural structure, the disclosed braking member and associated biasing element may be utilized within any other suitable application in which it is desired to prevent or inhibit rotation of a rotatable component.

It should also be appreciated that the disclosed cord drive assembly may correspond to an improvement over existing cord drive assemblies, particularly cord drive assemblies that utilize a Bendix-type mechanism to allow the cord drive to be engaged and disengaged from the output shaft or other output member of the assembly. For example, in one embodiment, the present subject matter may be utilized in connection with the cord drive assemblies disclosed in U.S. Patent Publication Nos. 2009/0120592 and 2009/0120593 (incorporated by reference herein above) to improve the overall operation of such assemblies by allowing a consistent, reliable braking force to be applied to the input member of the associated Bendix-type mechanism.

Referring now to FIG. 1, a partial, perspective view of one embodiment of a covering 20 configured for use relative to an architectural structure (e.g., a window) is illustrated in accordance with aspects of the present subject matter. In general, the covering 20 includes a top rail (not shown), a bottom rail (not shown), and a covering structure 30 configured to extend between the top and bottom rails. In the illustrated embodiment, the covering structure 30 corresponds to a plurality of slats 32. However, in other embodiments, the covering structure 30 may correspond to a shade panel, a cellular shade material, and/or the like. As shown in FIG. 1, lift cords 40 are configured to extend up from the bottom rail relative to the covering structure 30 (e.g., via openings 34 defined in the covering structure 30) and connect to lift stations 50, wherein the lift cords 40 wrap onto spools 52 of their corresponding lift stations 50 to raise the covering structure 30, and unwrap from the spools 52 to lower the covering structure 30. The spools 52 of the lift stations 50 are functionally connected to a cord drive assembly 100 of the covering 20 via a lift rod 54. As will be explained in greater detail below, short strokes of a drive cord 132 of the cord drive assembly 100 cause rotation of a corresponding output member 160 (FIG. 2) of the cord drive assembly 100. The output member 160, in turn, drives the lift rod 54, resulting in the rotation of the spools 52 of the lift stations 50 and the consequent raising of the covering structure 30 of the covering 20.

Referring now to FIGS. 2-13 (including FIG. 3A), several views of various components of one illustrative embodiment of a cord drive assembly 100 are illustrated in accordance with aspects of the present subject matter. As particularly shown in FIG. 2, the cord drive assembly 100 includes an outer housing 110. In one embodiment, the housing 110 may be formed from two separate housing shell members or components, such as a housing base 112 and a housing cover 114. The housing cover 114 may be configured to be coupled to the housing base 112 (e.g., via a snap fit or using any other suitable attachment means) such that the housing 110 at least partially encases the various internal components of the cord drive assembly 100. In one embodiment, both the housing base 112 and the housing cover 114 are made out of a plastic material, such as a molded plastic material. Additionally, as will be described in greater detail below, in one embodiment, one or both of the housing components 112, 114 includes a braking component or member (e.g., a cantilevered arm 120, 122) that is configured to apply a braking or restraining force against an internal rotating component of the cord drive assembly 100 to temporarily inhibit rotation of such component within the housing 110.

Figure 2:
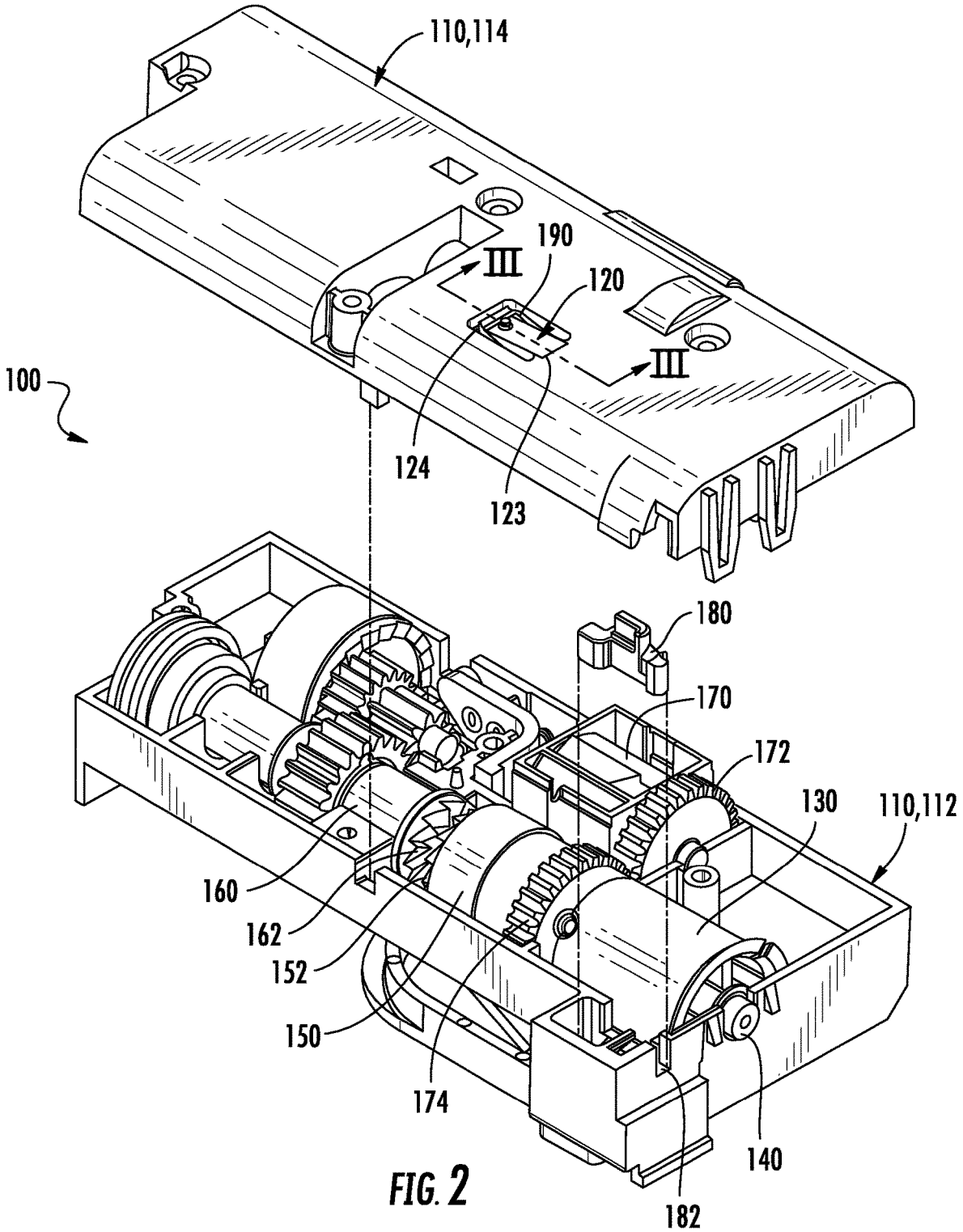
FIG. 2 illustrates a partially exploded, perspective view of one embodiment of the cord drive assembly shown in FIG. 1 in accordance with aspects of the present subject matter, particularly illustrating a housing cover of the cord drive assembly exploded away from a housing base of the cord drive assembly.

As shown in FIG. 2, in one embodiment, the cord drive assembly 100 includes a drive cord spool 130, a drive shaft 140 rotationally coupled to the drive cord spool 130, an input shaft or member 150, and an output shaft or member 160 (which, as indicated above, is functionally connected to the lift rod 54 of the covering 20). Additionally, in one embodiment, a clock or wrap spring 170 is functionally coupled with the drive cord spool 130 via circumferential gears 172, 174 such that, when the drive cord 132 (FIG. 1) is pulled downwardly by the operator to unwind the drive cord 132 from the drive cord spool 130 and raise the covering structure 30 of the covering 20, the coil spring 170 tightens or winds up. Thereafter, when the operator eases up on (or releases) the drive cord 132, the coil spring 170 may be allowed to unwind such that the drive cord spool 130 is rotationally driven in the opposite direction to wind the drive cord 132 back up onto the spool 130. Moreover, as shown in FIG. 2, the cord drive assembly 100 may also include a cord guide 180 configured to be positioned within the housing 110 at or adjacent to a cord opening 182 defined through the housing 110 for guiding the drive cord 132 relative to the drive cord spool 130. In one embodiment, the cord guide 180 may be formed from a more wear resistant material than the housing 110 to accommodate the drive cord 132 continuously rubbing against the outer surface(s) of the cord guide 180 as the cord drive assembly 100 is being operated.

Figure 3:
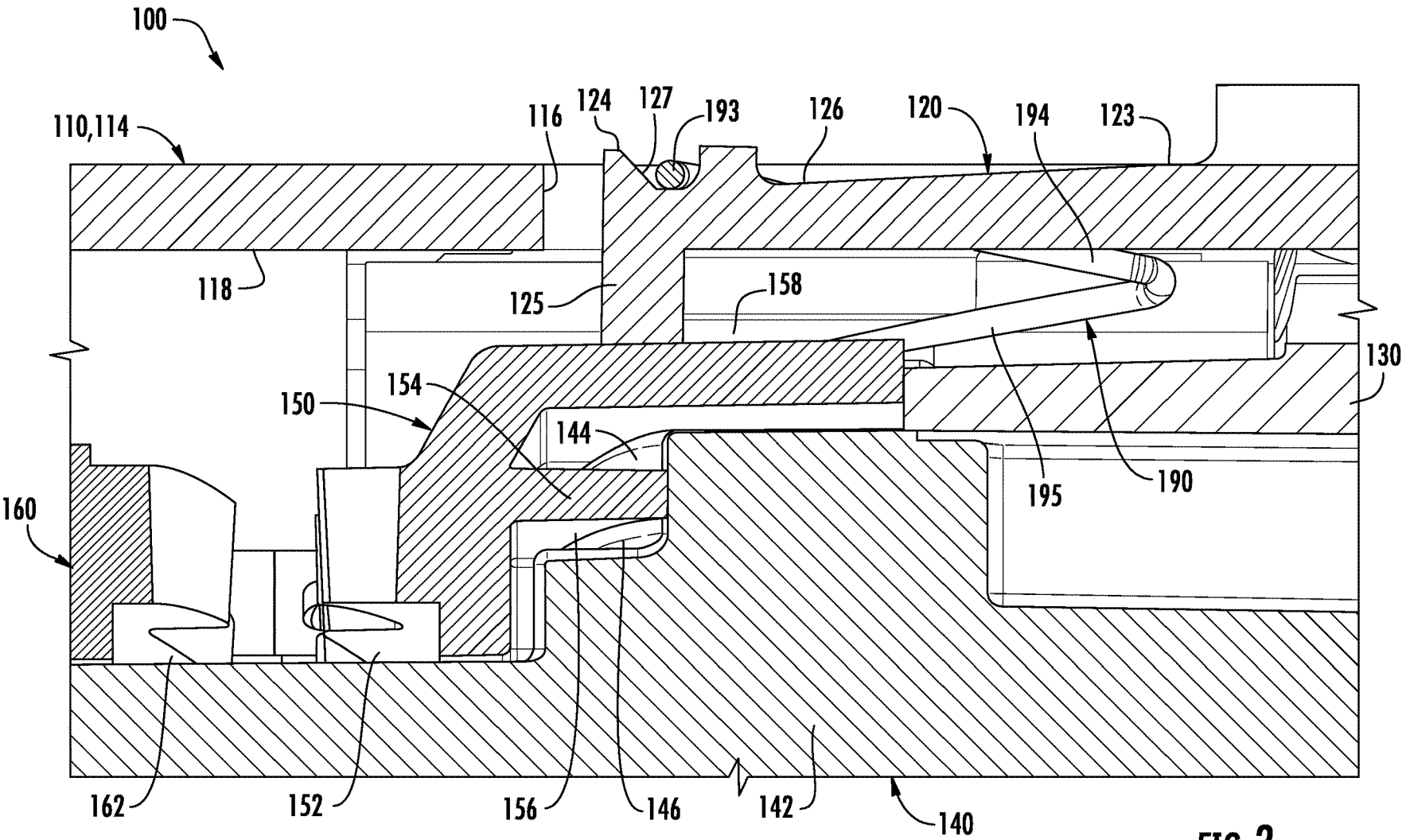
FIG. 3 illustrates a cross-sectional view of the cord drive assembly shown in FIG. 2 taken about line III-III when the housing cover is assembled relative to the housing base, particularly illustrating an input member of the cord drive assembly located at a disengaged axial position relative to an output member of the cord drive assembly, and further illustrating one embodiment of a braking member and associated biasing element of the cord drive assembly.
Figure 3A:
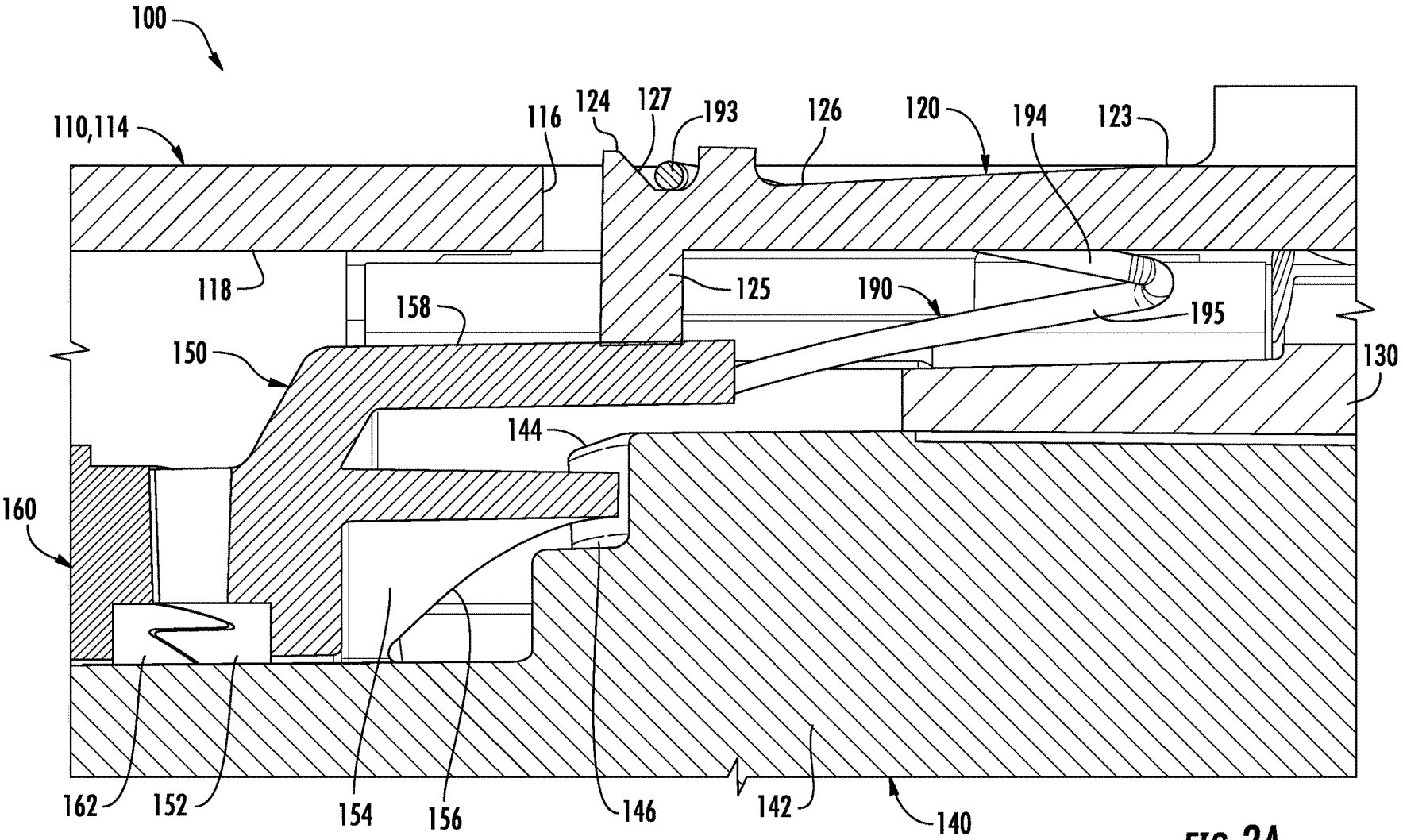
FIG. 3A illustrates a similar cross-sectional view of the cord drive assembly as that shown in FIG. 3, particularly illustrating the input member of the cord drive assembly located at an engaged axial position relative to the output member of the cord drive assembly.
Figure 4:
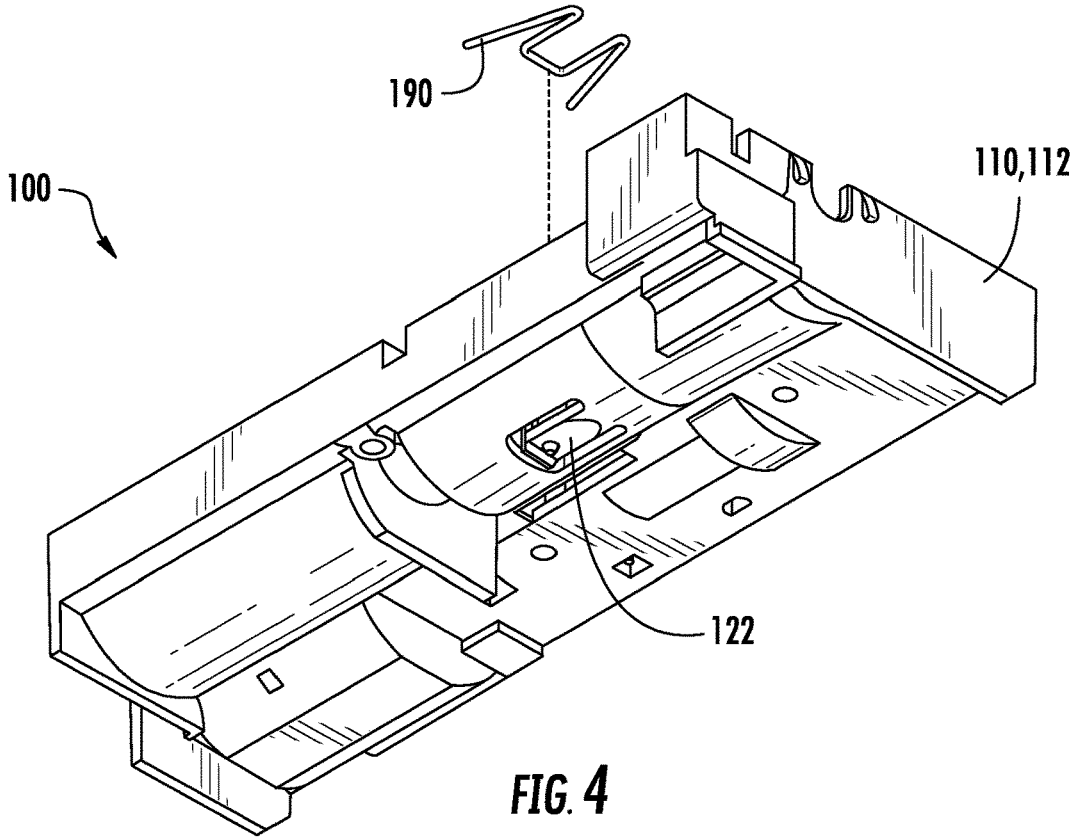
FIG. 4 illustrates a bottom, perspective view of the housing base shown in FIG. 2, particularly illustrating one embodiment of a biasing element of the cord drive assembly exploded away from the base in accordance with aspects of the present subject matter.
Figure 5:
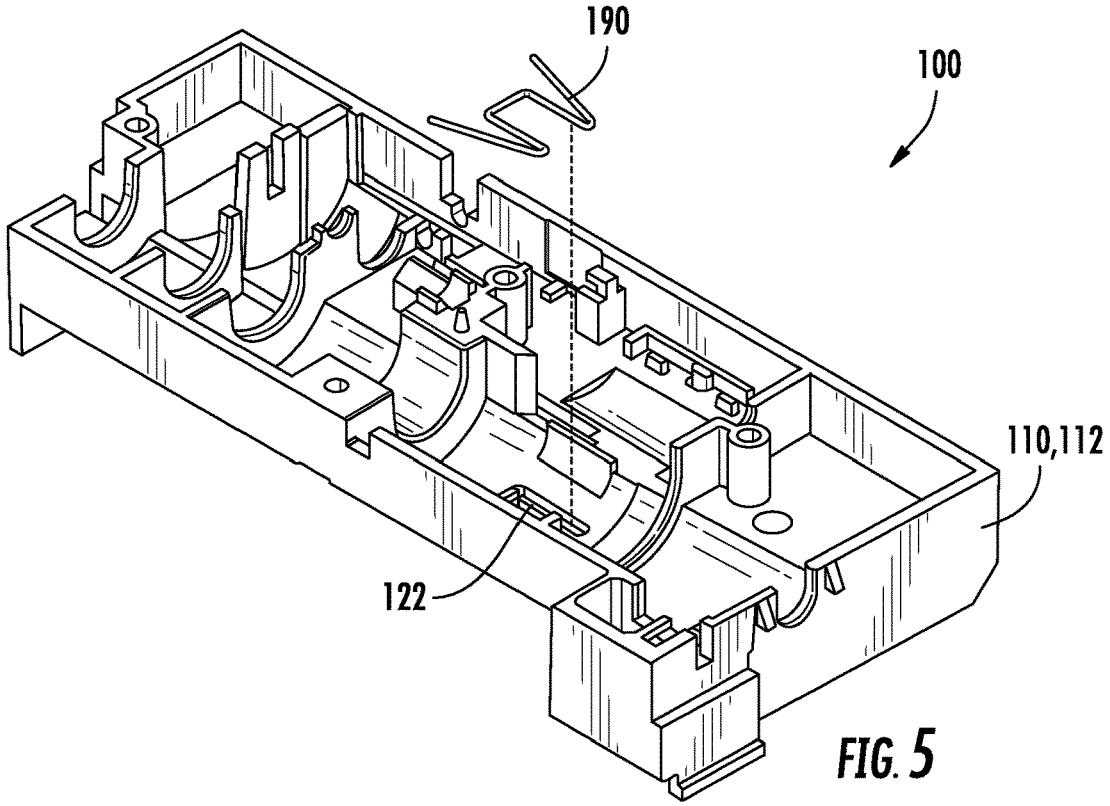
FIG. 5 illustrates a top, perspective view of the housing base shown in FIG. 4, with the biasing element exploded away from the base.
Figure 6:
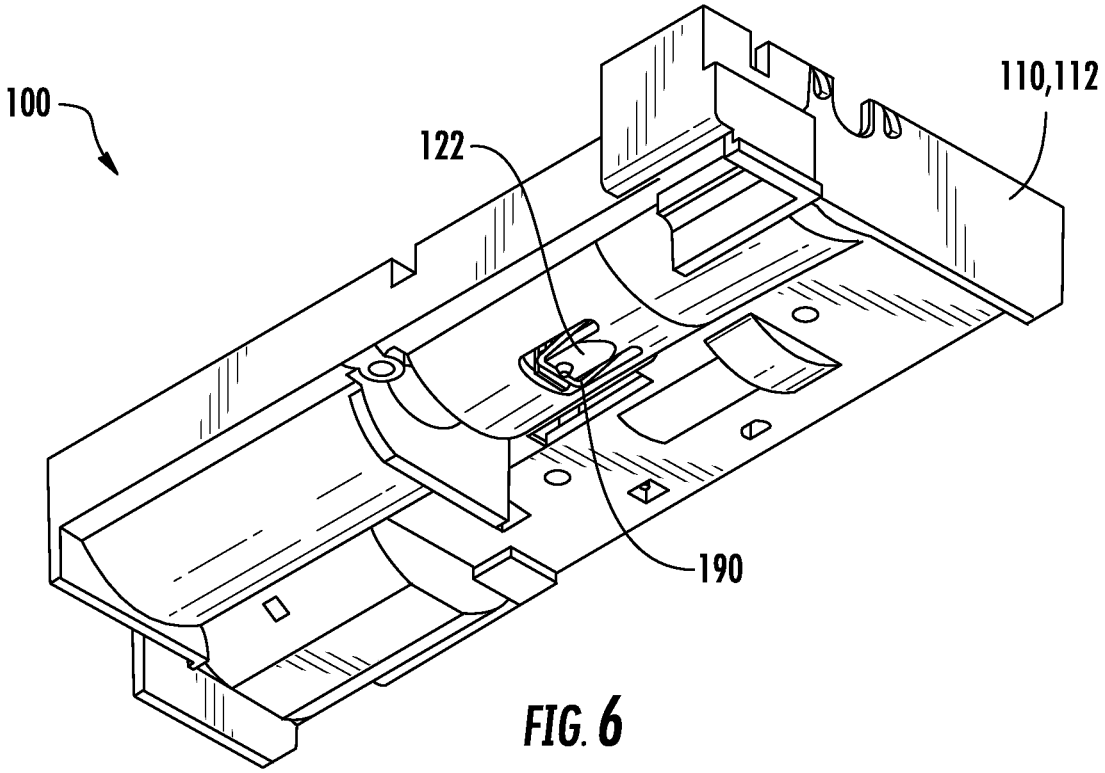
FIG. 6 illustrates the same view as that shown in FIG. 4, but with the biasing element installed relative to the housing base.
Figure 7:
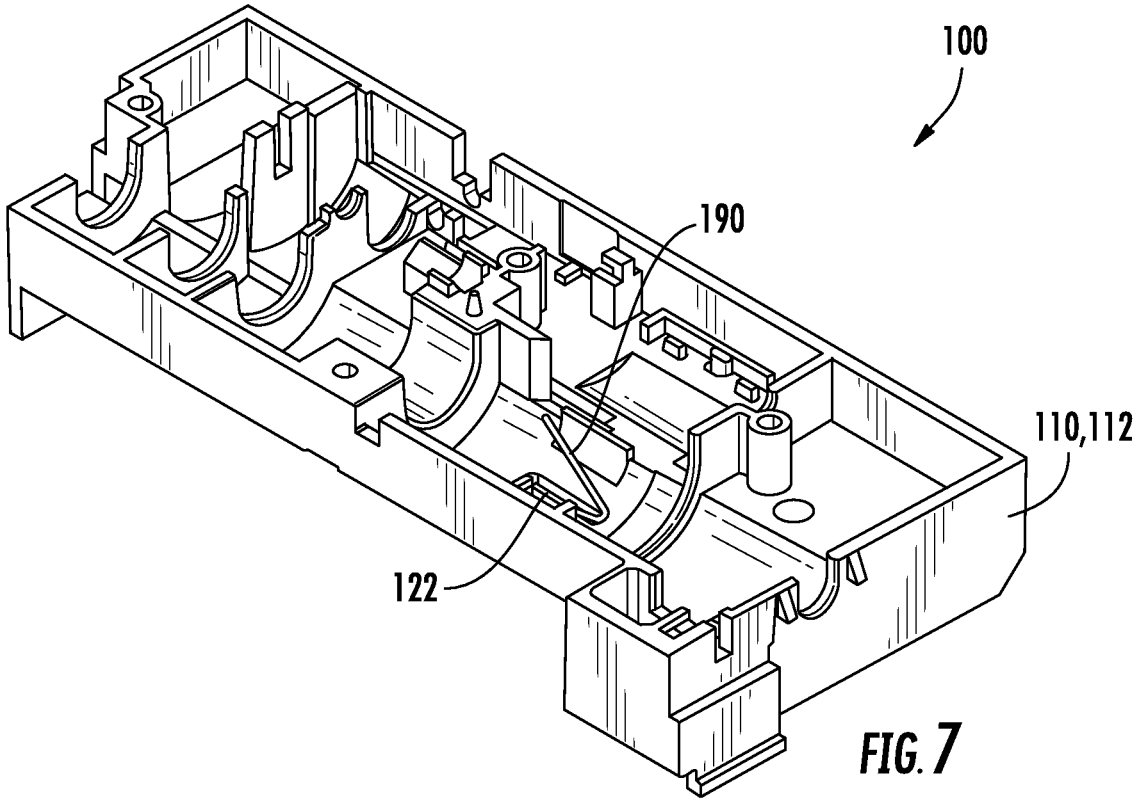
FIG. 7 illustrates the same view as that shown in FIG. 5, but with the biasing element installed relative to the housing base.
Figure 8:
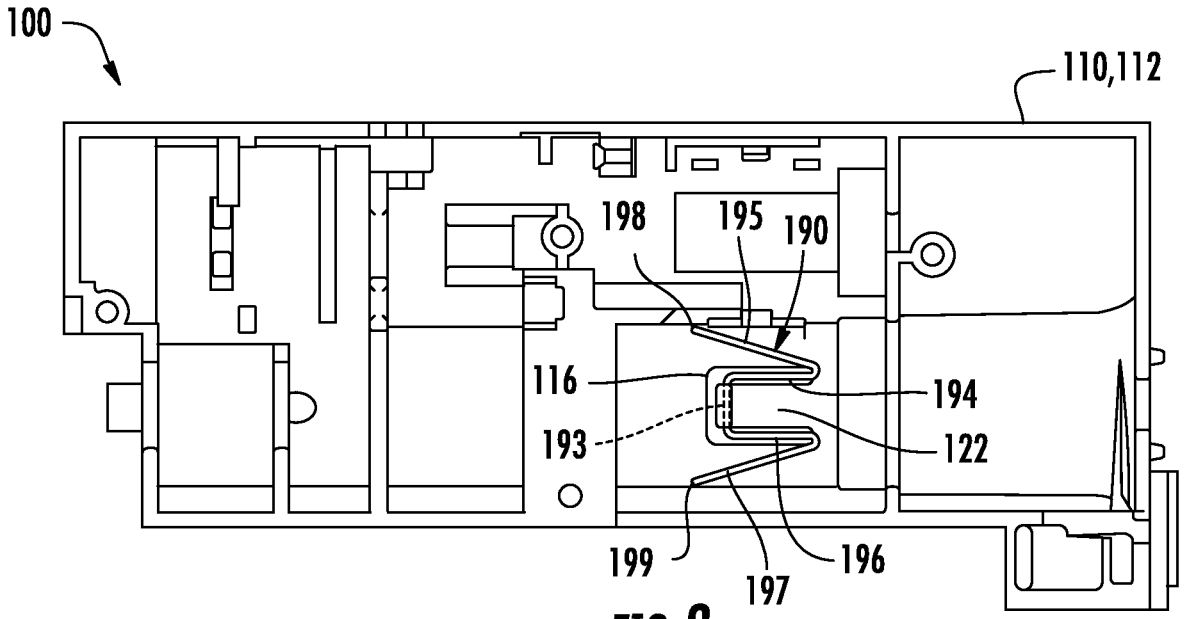
FIG. 8 illustrates a plan view of the assembled housing base and biasing element shown in FIG. 6.
Figure 9:
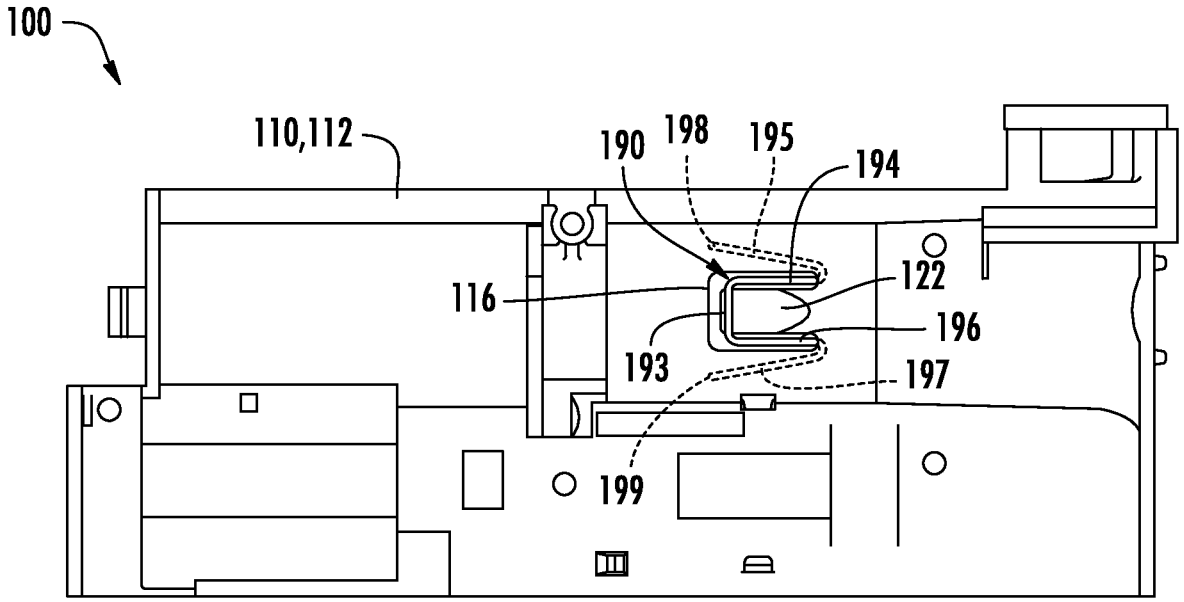
FIG. 9 illustrates a bottom view of the of the assembled housing base and biasing element shown in FIG. 6.
Figure 10:
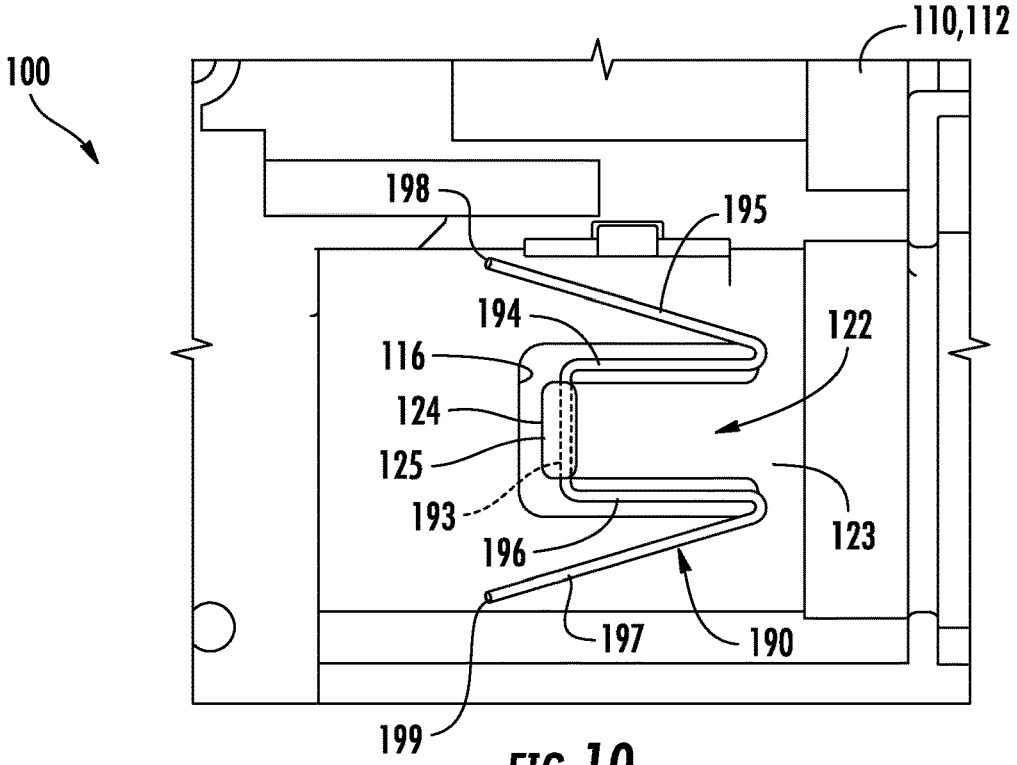
FIG. 10 illustrates an enlarged, broken-away view of the biasing element and housing base of FIG. 8.
Figure 11:
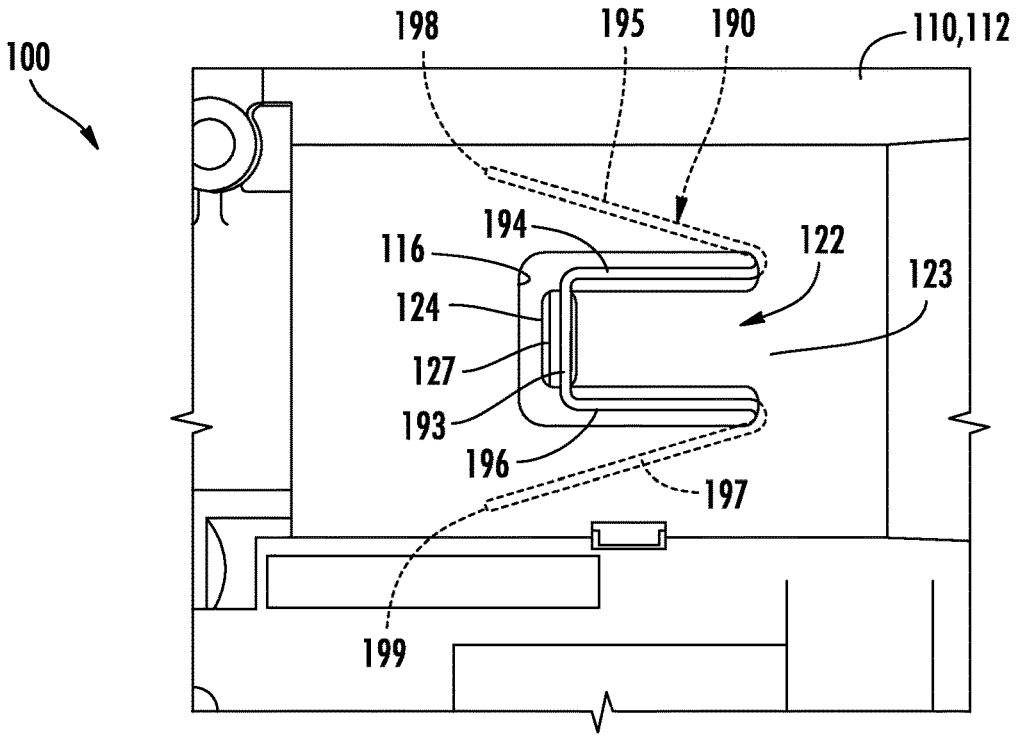
FIG. 11 illustrates an enlarged, broken-away view of the biasing element and housing base of FIG. 9.

As particularly shown in FIGS. 3 and 3A, the input member 150 of the cord drive assembly 100 may configured to be received on an axial portion 142 of the drive shaft 140 extending outwardly from the drive cord spool 130. In several embodiments, the input member 150 may be configured to slide axially along the axial portion 142 of the drive shaft 140 between the drive cord spool 130 and the output member 160 to allow the input member 150 to be moved relative to the output member 160 between a disengaged position (FIG. 3) and an engaged position (FIG. 3A). Specifically, as shown in FIG. 3, in the disengaged position, the input member 150 abuts against the drive cord spool 130 such that axially extending gear teeth 152 of the input member 150 are spaced apart axially from corresponding gear teeth 162 of the output member 160, thereby positioning the input member 150 in a disengaged state relative to the output member 160 and preventing rotational motion of the drive cord spool 130 and the drive shaft 140 from being transferred to the output member 160 via the input member 150. Similarly, as shown in FIG. 3A, to move input member 160 from the disengaged position to the engaged position, the input member 160 is slid or moved axially along the drive shaft 140 away from the drive cord spool 130 such that the gear teeth 152 of the input member 150 are rotationally engaged with the gear teeth 162 of the output member 160. Accordingly, when in the engaged position, rotational motion of the drive cord spool 130 and the drive shaft 140 may be transferred to the output member 160 via the rotational engagement of the gear teeth 152, 162 of the input and output members 150, 160.

To allow for such axial movement of the input member 150, the cord drive assembly 100 may incorporate aspects or features of a Bendix-type mechanism. For instance, as shown in FIGS. 3 and 3A, the input member 150 includes an internal engagement flange 154 defining a helically shaped or angled engagement surface 156 extending axially in the direction of the drive cord spool 130. Similarly, as shown in FIGS. 3 and 3A, the drive shaft 140 includes a corresponding external engagement flange 144 defining a helically shaped or angled engagement surface 146 extending axially in the direction of the input member 150. In such an embodiment, the engagement flanges 144, 154 may be configured to be axially aligned so that, when the drive shaft 140 is rotated relative to the input member 150, the external engagement flange 144 of the drive shaft 140 contacts the internal engagement flange 154 of the input member 150, thereby causing the input member 150 to be pushed axially towards the output shaft 160 due to the engagement provided between the mating engagement surfaces 146, 156 of the engagement flanges 144, 154. In addition, a spring (not shown) may be positioned between the input member 150 and the output member 160 to bias the input member 150 towards its disengaged position. In such instance, the contact between the engagement flanges 144, 154 may push the input member 150 towards the output shaft 160 against the biasing force applied by the spring.

It should be appreciated that, in other embodiments, the cord drive assembly 100 may have any other suitable Bendix-type configuration that allows a rotating member or component of the cord drive assembly 100 (e.g., such as the input member 150) to be moved axially relative to a corresponding component of the cord drive assembly 100 (e.g., such as the output member 160) between disengaged and engaged positions, thereby allowing such components to be rotationally decoupled and coupled, respectively, relative to each other.

It should also be appreciated that, given the configuration of the cord drive assembly 100 described above and, absent any restraining force being applied to the input member 150, the input member 150 has a tendency to rotate together with the drive cord spool 130 and the drive shaft 140 when in the disengaged position (e.g., as shown in FIG. 3). However, for the Bendix-type mechanism of the cord drive assembly 100 to function as described above, the drive shaft 140 must be allowed to rotate relative to the input member 150 at least until the external engagement flange 144 of the drive shaft 140 has sufficiently engaged the corresponding engagement flange 154 of the input member 150 so as to push the input member 150 axially toward the output member 160 into the engaged position (e.g., as shown in FIG. 3A wherein the gear teeth 152 of the input member 150 rotationally engage the corresponding gear teeth 162 on the output member 160 to allow rotational motion to be transferred from the input member 150 to the output member 160). In contrast, if the input member 150 is allowed to rotate with the drive shaft 140 before the engagement flange 144 of the drive shaft 140 contacts the engagement flange 154 of the input member 150 and pushes the input member 150 axially into engagement with the output member 160, then two outcomes are possible, both of which are undesirable. First, the drive shaft 140 may never rotationally or circumferentially "catch up" to the input member 150, thereby preventing or delaying the engagement flange 144 of the drive shaft 140 from contacting the engagement flange 154 of the input member 150. That is, the related Bendix-type action may never occur or, if it does occur, it may be so delayed that most, if not all, of the available stroke in the drive cord 132 is consumed before any rotation is transmitted to the input member 150 and, thus, to the output shaft 160 to allow the covering structure 30 to be raised. Second, the rotating input member 150 may cause "grinding" of the gear teeth 152, 162 due to partial engagement between the input member 150 and the output member 160, thereby resulting in undesirable wear and/or failure of the gear teeth 152, 162.

As indicated above, to inhibit or prevent premature rotation of the input member 150, the cord drive assembly 100 may include one or more braking members configured to provide a braking or restraining force against the input member 150. Specifically, in several embodiments, the braking member(s) may correspond to one or more cantilevered arms of the housing 110. For instance, as shown in FIGS. 2, 3 and 3A, the housing cover 114 may include a first cantilevered arm 120. In one embodiment, the first cantilevered arm 120 is formed integrally with the cover 114 itself. For instance, as shown in FIGS. 3 and 3A, the first cantilevered arm 120 may extend between a proximal end 123 and a distal end 124, with the proximal end 123 merging into the cover 114 and the distal end 124 projecting or extending into an opening 116 formed in the cover 114. Alternatively, the first cantilevered arm 120 may be configured to be separately coupled to the housing cover 114 such that the distal end 124 of the arm 120 extends into the opening 116. Additionally, as shown in FIGS. 3 and 3A, the cantilevered arm 120 includes radially inwardly extending finger 125 at or adjacent to its distal end 124 that is configured to contact and push against a radially outer surface 158 of the input member 150. Such frictional contact between the finger 125 of the cantilevered arm 120 and the input member 150 provides the restraining force that inhibits or prevents the input member 150 from rotating with the drive shaft 140 until the shaft 140 has engaged and pushed the input member 150 axially towards the output member 160 via contact between the corresponding engagement flanges 144, 154.

It should be appreciated that, in one embodiment, a second cantilevered arm 122 (FIGS. 4-11) may be provided on the housing base 112 that is configured to push inwardly against the input member 150 (e.g., by configuring the second cantilevered arm 122 the same as or similar to the first cantilevered arm 120). For instance, when the housing 110 is assembled, the first cantilevered arm 120 on the housing cover 114 may be positioned opposite the second cantilevered arm 122 on the housing base 112. In such an embodiment, the first cantilevered arm 120 may be configured to apply a restraining force against one side of the input member 150 while the second cantilevered arm 122 may be configured to apply a restraining force against the opposed side of the input member 150. However, it should be appreciated that, in alternative embodiments, the housing 110 may only include a single cantilevered arm configured to apply an inwardly directed, restraining force against the input member 150.

Additionally, in several embodiments, to ensure that a sufficient restraining force is applied against the input member 150 via the cantilevered arms 120, 122, a biasing element is provided in operative association with each cantilevered arm 120, 122. In general, each biasing element may be configured to apply a biasing force against its corresponding cantilevered arm 120, 122 that biases the radially extending finger 125 of such arm 120, 122 into engagement with the input member 150. As such, even when the cantilevered arms 120, 122 are formed from a material that has a tendency to cold flow over time (e.g., a plastic material), the biasing force provided by the biasing elements may maintain the cantilevered arms 120, 122 frictionally engaged with the input member 150 to properly inhibit or prevent premature rotation of the input member 150.

In several embodiments, each biasing element may correspond to a spring configured to apply a radially inwardly directed biasing force against its corresponding cantilevered arm 120, 122. In such embodiments, the specific spring configuration of the biasing elements used within the disclosed cord drive assembly 100 may vary depending on the configuration of the cantilevered arms 120, 122 and/or the housing 110, itself. Thus, it should be appreciated that various different spring configurations may be utilized within the cord drive assembly 100 without departing from the scope and spirit of the present subject matter.

Figure 12:
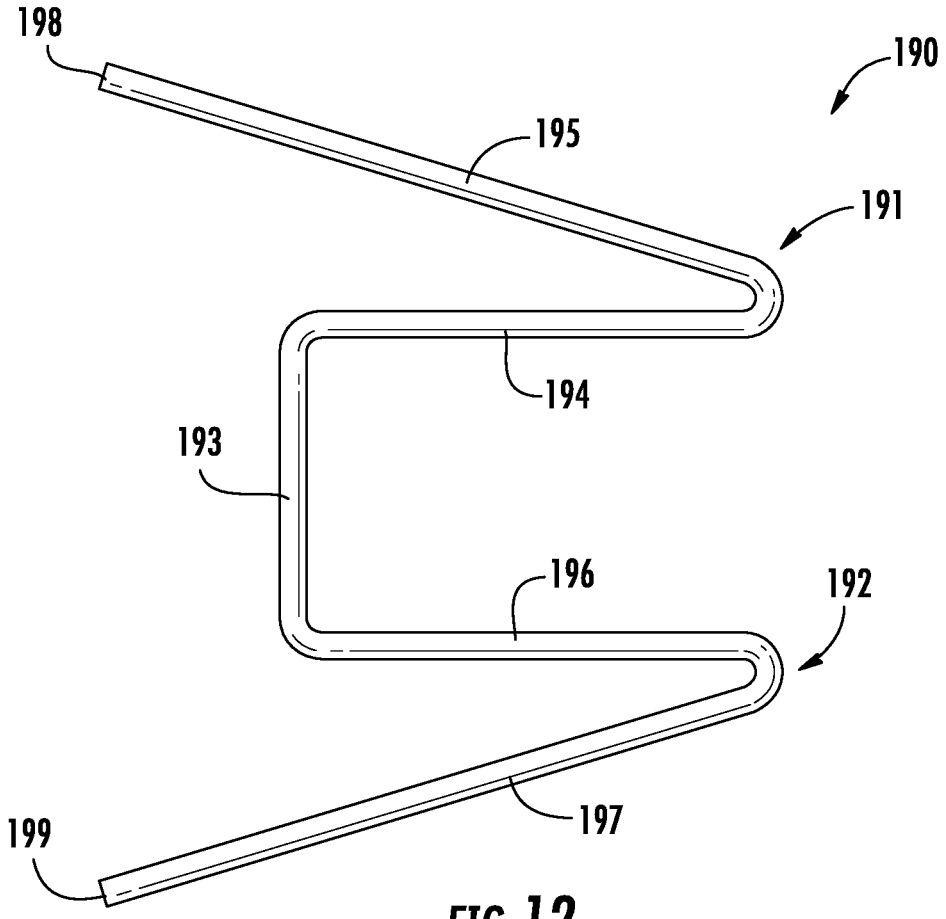
FIG. 12 illustrates a plan view of the biasing element shown in FIGS. 2-11.

For example, in the embodiment illustrated in FIGS. 2-13, each biasing element 190 corresponds to a "W-shaped" torsion spring configured to be installed relative to one of the cantilevered arms 120, 122 such that the spring biases the arm 120, 122 radially inwardly towards the input member 150. As particularly shown in FIG. 12, the biasing element 190 includes first and second side portions 191, 192 interconnected by a flat, straight central portion 193, with the side portions 191, 192 and the central portion 193 generally defining the "W-shaped" profile of the spring. As shown in FIG. 12, the first side portion 191 includes a first inner leg 194 and a first outer leg 195, with the first inner leg 194 extending between the central portion 193 and the first outer leg 195 and the first outer leg 195 extending between the first inner leg 194 and a first end 198 of the biasing element 190. Additionally, as shown in FIG. 12, the second side portion 192 includes a second inner leg 196 and a second outer leg 197, with the second inner leg 196 extending between the central portion 193 and the second outer leg 197 and the second outer leg 197 extending between the second inner leg 196 and a second end 199 of the biasing element 190.

In one embodiment, the central portion 193 of each biasing element 190 may be configured to engage an outer side or surface 126 of its respective cantilevered arm 120, 122. For instance, as shown in FIGS. 3 and 3A, the central portion 193 of the biasing element 190 may be received within a depression 127 defined along the outer surface 126 of the cantilevered arm 120. Thus, once the biasing element 190 is installed, the central portion 193 of the biasing element 190 bears against the outer surface 126 of its respective cantilevered arm 120, 122, biasing the distal end 124 of the cantilevered arm 120, 122 inwardly, such that the finger 125 pushes against the input member 150 to hinder or inhibit its rotation. In addition, as shown in FIGS. 3 and 3A, all or part of the first and second side portions 191, 192 of the biasing element 190 may be configured to be engaged against an adjacent inner surface 118 of the housing 110. Specifically, in one embodiment, the inner legs 194, 196 of the side portions 191, 192 may be configured to extend through the opening 116 defined in the housing 110 that surrounds the adjacent cantilevered arm 120, 122 while the outer legs 195, 197 of the side portions 191, 192 of the biasing element 190 may extend along the inside of the housing 110 and bear against the inner surface 118 of the adjacent housing component (e.g., either the base 112 and/or the cover 114).

Figure 13:
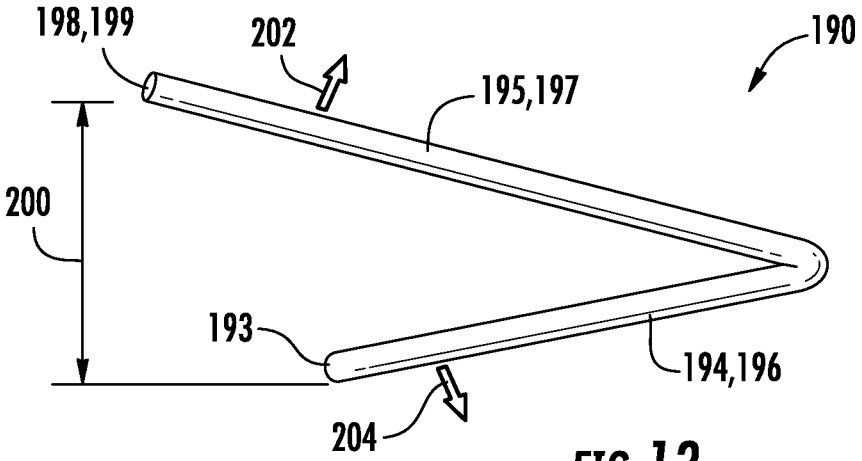
FIG. 13 illustrates a side view of the biasing element shown in FIG. 12.

It should be appreciated that, in several embodiments, the biasing element 190 may be non-planar in its neutral or "at rest" state. For instance, as shown in FIG. 13, the opposed ends 198, 199 of the biasing element 190 are offset from the central portion 193 by an offset distance 200. As such, when the biasing element 190 is installed relative to the housing 110, the ends 198, 199 of the biasing element 190 may be allowed to bear against the inner surface 118 of the adjacent housing component (e.g., either the base 112 and/or the cover 114) while the central portion 193 bears against the outer surface 126 of the respective cantilevered arm 120, 122. Specifically, upon installation of the biasing element 190 (e.g., such that the central portion 193 is engaged in the depression 127 of the cantilevered arm 120, 122, the inner legs 194, 196 are projecting through the slotted opening 116 surrounding the cantilevered arm 120, 122, and the ends 198, 199 of the outer legs 195, 197 are bearing against the inner surface 118 of the housing 110), the biasing element 190 is slightly stretched out in the direction shown by arrows 202 and 204 in FIG. 13. Given that the biasing element 190 is designed to return to its "at rest" position, the spring force of the biasing element 190 attempts to push its central portion 193 and side portions 191, 192 closer together (e.g., in a direction opposite the direction of the arrows 202, 204 shown in FIG. 13). In such instance, since the only part of the housing 110 designed to "give" or flex is the distal end 124 of the cantilevered arm 120, 122, the distal end 124 is pushed inwardly by the spring action of the biasing element 190, thereby forcing the finger 125 against the outer surface 158 of the input member 150. In doing so, the exact dimension(s) of the lever arms formed by the outer legs 195, 197 of the side portions 191, 192 of the biasing element 190 may be selected, as desired, to ensure that the force exerted by the cantilevered arm 120, 122 on the input member 150 is consistent and not excessive.

It should be appreciated that, when the biasing element corresponds to a spring, the spring may be formed from any suitable material, such as a metal material (e.g., steel and/or any other suitable metal material). Additionally, it should be appreciated that, although a "W-shaped" spring has been shown in the illustrated embodiment, any other suitable spring configuration or shape may be utilized that allows the biasing element to function as described herein. For instance, in an alternative embodiment, the biasing element may correspond to a "U-shaped" spring. As indicated above, the specific shape of any spring(s) used may vary, for example, depending on the configuration of the cantilevered arm(s) 120, 122 and/or the configuration of the housing 110 itself.

It should also be appreciated that, in the illustrated embodiment, a biasing element has been provided in operative association with each cantilevered arm 120, 122. However, in alternative embodiments, a biasing element may only be provided in operative association with one of the cantilevered arms, such as the first cantilevered arm 120 or the second cantilevered arm 122.

Moreover, it should be appreciated that, in alternative embodiments, each biasing element may correspond to any other suitable device, mechanism, material, component, and/or the like that is configured to apply a biasing force against its respective cantilevered arm 120, 122 that biases the arm 120, 122 into engagement with the input member 150 of the cord drive assembly 100. For instance, in another embodiment, each biasing element may be formed from an expandable/compressible or elastic material that, when installed relative to the housing/arm, applies a biasing force against the respective cantilevered arm 120, 122.

Figure 14:
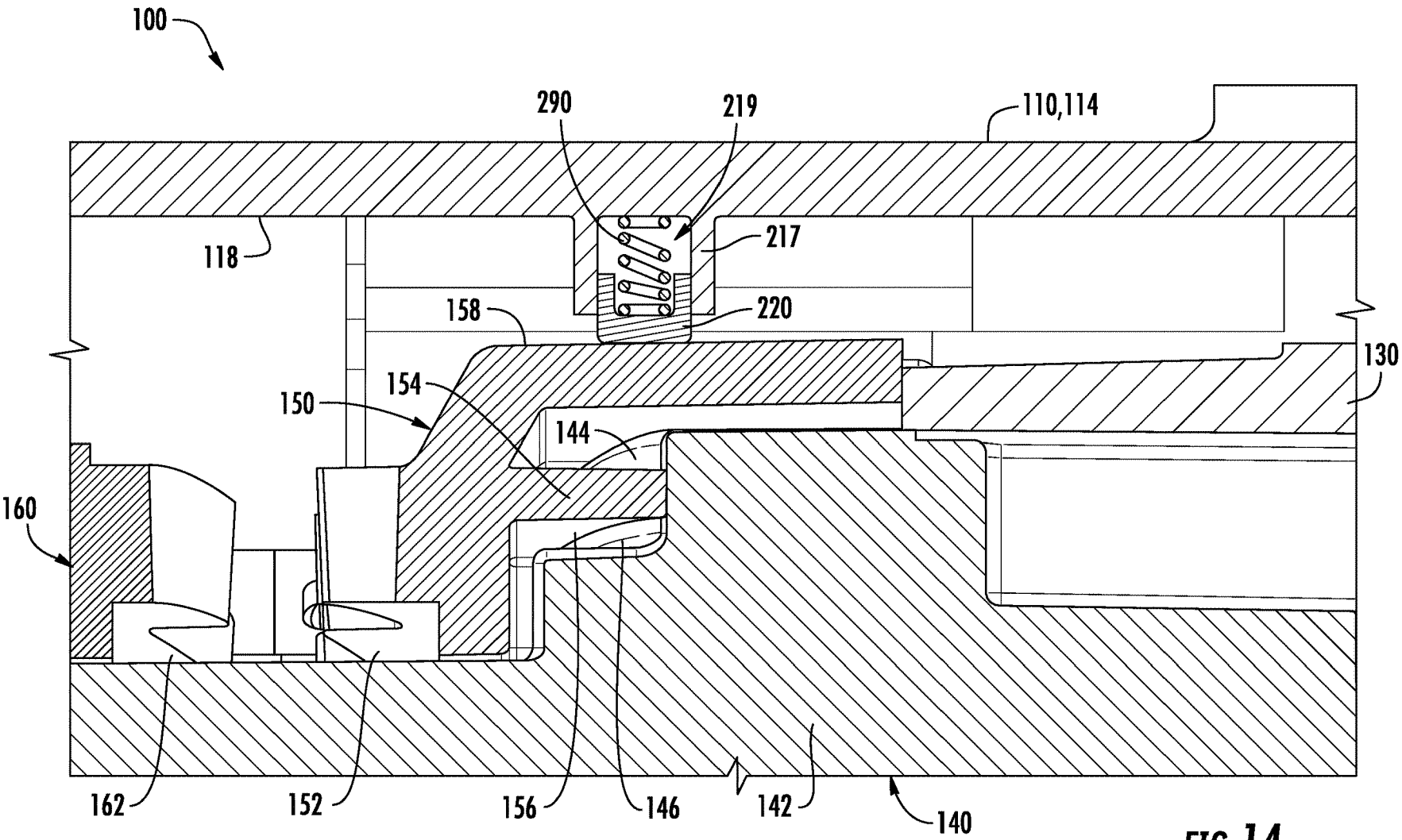
FIG. 14 illustrates similar cross-sectional view of the cord drive assembly as that shown in FIG. 3, particularly illustrating another embodiment of a braking member and associated biasing element suitable for use within the disclosed cord drive assembly in accordance with aspects of the present subject matter.

In addition, it should be appreciated that, in alternative embodiments, the biasing element may be configured to apply a biasing force against any other suitable braking component(s) or member(s) configured to generally function as described herein (e.g., to restrain or inhibit rotation of the input member 150). For instance, FIG. 14 illustrates a similar cross-sectional view of the cord drive assembly 100 as that shown in FIG. 3, but illustrating an alternative embodiment of a suitable braking member 220 that may be used to restrain or inhibit rotation of the input member 150. As shown in FIG. 14, unlike the integrally formed arms 120, 122 described above, the braking member 220 corresponds to a separate brake component installed within the housing 110 so that the brake member 220 is engaged against and applies a restraining force against the input member 150. In such an embodiment, a suitable biasing element 290 (e.g., a compression spring) may be installed between the housing 110 and the brake member 220 to bias the brake member 220 into engagement with the input member 150. As shown in FIG. 14, to maintain the biasing element 290 and the brake member 220 in position, the housing 110 may include a retaining wall 217 (e.g., a cylindrically shaped wall) defining a cavity 219 configured to at least partially receive the biasing element 290 and the brake member 220.

Figure 15:
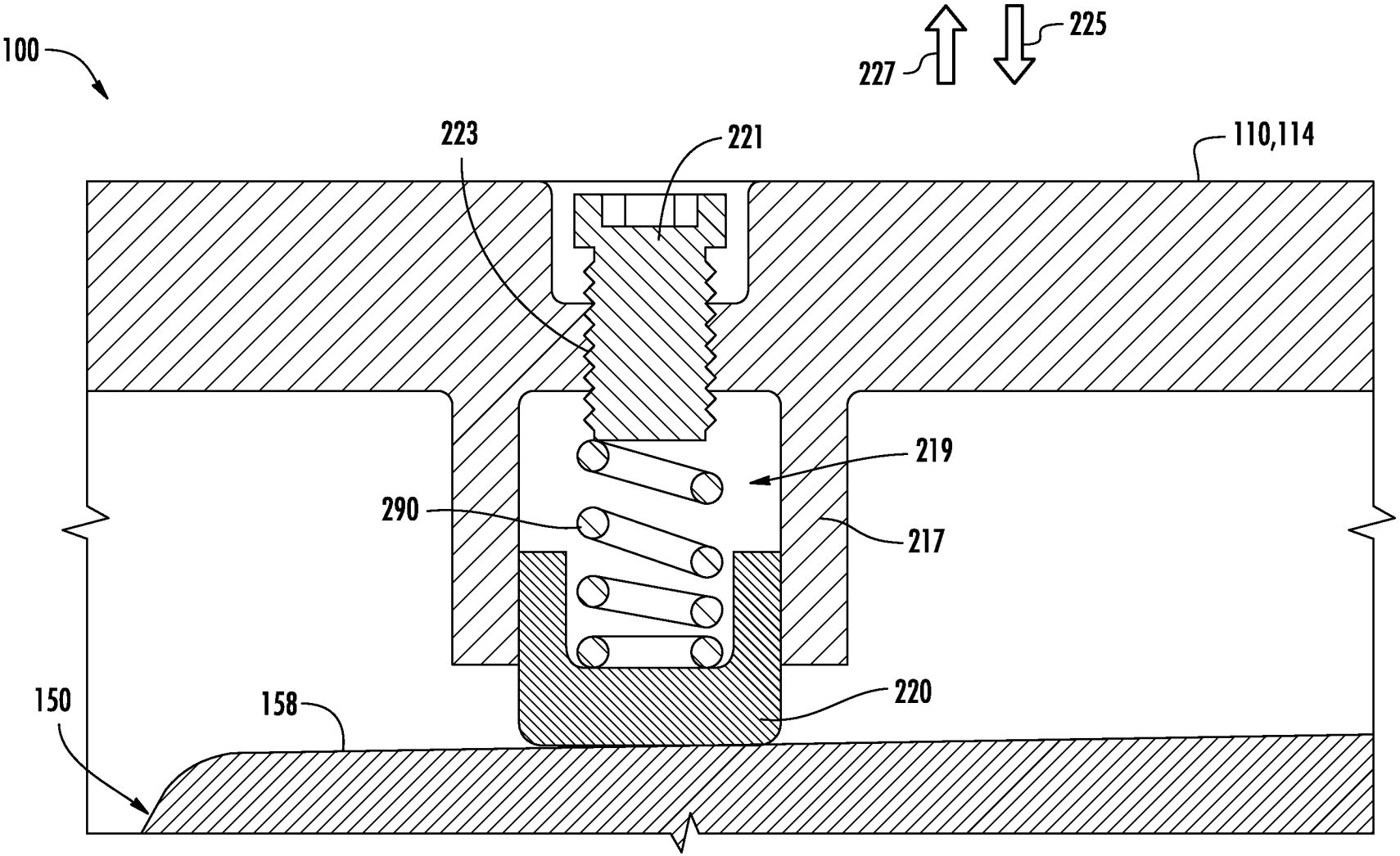
FIG. 15 illustrates an enlarged view of a portion of the cross-sectional view of the cord-drive assembly shown in FIG. 14, particularly illustrating a configuration that allows the biasing element to apply an adjustable biasing force against the associated brake member.

Moreover, it should be appreciated that, in one embodiment, the biasing element described herein may be configured to apply an adjustable biasing force against the associated braking component(s) or member(s). In such an embodiment, the adjustability of the biasing force may allow the cord drive assembly to be tuned based on the braking requirements for each specific application. For example, FIG. 15 illustrates an enlarged view of a portion of the cord-drive assembly 100 shown in FIG. 14, particularly illustrating an embodiment of a configuration that allows the biasing element 290 to apply an adjustable biasing force against the brake member 220. As shown in FIG. 14, an adjustment member 221 (e.g., a set screw) may be provided through an opening 223 defined in the housing 110 (e.g., a threaded opening) to allow the compression of the biasing element 290 within the cavity 219 to be increased or decreased, thereby increasing or decreasing the associated braking force applied by the brake member 220 against the outer surface 158 of the input member 150. For instance, in the illustrated embodiment, by moving the adjustment member 221 relative to the housing 110 in a first direction (e.g., as indicated by arrow 225 in FIG. 15), such as by rotating or screwing the adjusting member 221 relative to the housing 110 so that the adjustment member 221 translates in the first direction 225, the compression of the biasing element 290 may be increased, thereby increasing the braking force applied by the brake member 220. Similarly, by moving the adjustment member 221 relative to the housing 110 in a second, opposite direction (e.g., as indicated by arrow 227 in FIG. 15), such as by rotating or screwing the adjusting member 221 relative to the housing 110 so that the adjustment member 221 translates in the second direction 227, the compression of the biasing element 290 may be decreased, thereby decreasing the braking force applied by the brake member 220.

While the foregoing Detailed Description and drawings represent various embodiments, it will be understood that various additions, modifications, and substitutions may be made therein without departing from the spirit and scope of the present subject matter. Each example is provided by way of explanation without intent to limit the broad concepts of the present subject matter. In particular, it will be clear to those skilled in the art that principles of the present disclosure may be embodied in other forms, structures, arrangements, proportions, and with other elements, materials, and components, without departing from the spirit or essential characteristics thereof. For instance, features illustrated or described as part of one embodiment can be used with another embodiment to yield a still further embodiment. Thus, it is intended that the present subject matter covers such modifications and variations as come within the scope of the appended claims and their equivalents. One skilled in the art will appreciate that the disclosure may be used with many modifications of structure, arrangement, proportions, materials, and components and otherwise, used in the practice of the disclosure, which are particularly adapted to specific environments and operative requirements without departing from the principles of the present subject matter. For example, elements shown as integrally formed may be constructed of multiple parts or elements shown as multiple parts may be integrally formed, the operation of elements may be reversed or otherwise varied, the size or dimensions of the elements may be varied. The presently disclosed embodiments are therefore to be considered in all respects as illustrative and not restrictive, the scope of the present subject matter being indicated by the appended claims, and not limited to the foregoing description.

In the foregoing Detail Description, it will be appreciated that the phrases "at least one", "one or more", and "and/or", as used herein, are open-ended expressions that are both conjunctive and disjunctive in operation. The term "a" or "an" element, as used herein, refers to one or more of that element. As such, the terms "a" (or "an"), "one or more" and "at least one" can be used interchangeably herein. All directional references (e.g., proximal, distal, upper, lower, upward, downward, left, right, lateral, longitudinal, front, rear, top, bottom, above, below, vertical, horizontal, crosswise, radial, axial, clockwise, counterclockwise, and/or the like) are only used for identification purposes to aid the reader's understanding of the present subject matter, and/or serve to distinguish regions of the associated elements from one another, and do not limit the associated element, particularly as to the position, orientation, or use of the present subject matter. Connection references (e.g., attached, coupled, connected, joined, secured, mounted and/or the like) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another.

All apparatuses and methods disclosed herein are examples of apparatuses and/or methods implemented in accordance with one or more principles of the present subject matter. These examples are not the only way to implement these principles but are merely examples. Thus, references to elements or structures or features in the drawings must be appreciated as references to examples of embodiments of the present subject matter, and should not be understood as limiting the disclosure to the specific elements, structures, or features illustrated. Other examples of manners of implementing the disclosed principles will occur to a person of ordinary skill in the art upon reading this disclosure.

This written description uses examples to disclose the present subject matter, including the best mode, and also to enable any person skilled in the art to practice the present subject matter, including making and using any devices or systems and performing any incorporated methods. The patentable scope of the present subject matter is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

The following claims are hereby incorporated into this Detailed Description by this reference, with each claim standing on its own as a separate embodiment of the present disclosure. In the claims, the term "comprises/comprising" does not exclude the presence of other elements or steps. Furthermore, although individually listed, a plurality of means, elements or method steps may be implemented by, e.g., a single unit or processor. Additionally, although individual features may be included in different claims, these may possibly advantageously be combined, and the inclusion in different claims does not imply that a combination of features is not feasible and/or advantageous. In addition, singular references do not exclude a plurality. The terms "a", "an", "first", "second", etc., do not preclude a plurality. Reference signs in the claims are provided merely as a clarifying example and shall not be construed as limiting the scope of the claims in any way.

What is claimed is:

1. A cord drive assembly for raising a covering relative to an architectural structure, said cord drive comprising:

a housing;

a cord drive component mounted for rotation within said housing;

a braking member extending from said housing and being configured to apply a braking force against said cord drive component in a braking direction toward said cord drive component to at least partially hinder rotation of said cord drive component within said housing; and a biasing element separate from said braking member, said biasing element positioned and configured to engage said braking member and to apply a biasing force against said braking member in the braking direction, the biasing force biasing said braking member against said cord drive component;

wherein said biasing element extends from an interior of said housing to an exterior of said housing such that a first portion of said biasing element is disposed outside said housing while a second portion of said biasing element is positioned within the interior of said housing.

2. The cord drive assembly of claim 1, wherein:

said cord drive component is movable axially within said housing relative to an output member of said cord drive assembly between a first position and a second position;

said cord drive component is rotationally decoupled from said output member when said cord drive component is moved to the first position; and said cord drive component is rotationally coupled to said output member when said cord drive component is moved to the second position.

3. The cord drive assembly of claim 2, wherein:

said cord drive component corresponds to a first cord drive component and said cord drive assembly further comprises a second cord drive component configured to rotate relative to said first cord drive component when said first cord drive component is located at the first position such that a portion of said second cord drive component contacts a corresponding portion of said first cord drive component to push said first cord drive component axially from the first position to the second position.

4. The cord drive assembly of claim 3, wherein said braking member is configured to at least partially hinder rotation of said first cord drive component-when said first cord drive component is located at the first position and said second cord drive component is rotating relative to said first cord drive component.

5. The cord drive assembly of claim 1, wherein said biasing element comprises a spring provided in operative association with said braking member.

6. The cord drive assembly of claim 5, wherein said spring comprises a first portion configured to be engaged against a portion of said braking member and a second portion configured to be engaged against a portion of said housing.

7. The cord drive assembly of claim 6, wherein said first portion is configured to be engaged against an outer surface of said braking member along an exterior of said housing and said second portion is configured to be engaged against an inner surface of said housing within the interior of said housing.

8. The cord drive assembly of claim 7, wherein:

said first portion corresponds to a central portion of said spring extending along said outer surface of said braking member; and said second portion corresponds to opposed side portions of said spring extending outwardly from said central portion of said spring such that each of said opposed side portions engages said inner surface of said housing.

9. The cord drive assembly of claim 1, wherein said braking member comprises a cantilevered arm extending within an opening defined through said housing.

10. The cord drive assembly of claim 9, wherein said cantilevered arm is formed integrally with said housing.

11. The cord drive assembly of claim 9, wherein:

said cantilevered arm extends between a proximal end and a distal end;

said proximal end is formed integrally with or coupled to said housing; and said distal end extends within said opening defined by said housing.

12. The cord drive assembly of claim 11, wherein said biasing element is configured to bias said distal end of said cantilevered arm in the braking direction towards said cord drive component.

13. The cord drive assembly of claim 9, wherein said cantilevered arm is formed from a plastic material.

14. A cord drive assembly for raising a covering relative to an architectural structure, said cord drive comprising:

a housing including a housing wall defining an outer surface extending along an exterior of said housing and an inner surface extending within an interior of said housing, said housing including a cantilevered arm positioned relative to said housing wall such that an outer side of said cantilevered arm is positioned along the exterior of said housing and an inner side of said cantilevered arm is positioned along the interior of said housing;

a cord drive component mounted for rotation within said housing about a cord drive axis of rotation; and a spring positioned and configured to engage said cantilevered arm;

wherein:

said cantilevered arm applies a braking force against said cord drive component in a braking direction oriented radially inwardly towards said cord drive axis of rotation to at least partially hinder rotation of said cord drive component within said housing; and said spring applies a radially inwardly directed biasing force against said outer side of said cantilevered arm, the biasing force biasing said cantilevered arm against said cord drive component.

15. The cord drive assembly of claim 14, wherein:

said cord drive component is movable axially within said housing relative to an output member of said cord drive assembly between a first position and a second position;

said cord drive component is rotationally decoupled from said output member when said cord drive component is moved to the first position; and said cord drive component is rotationally coupled to said output member when said cord drive component is moved to the second position.

16. The cord drive assembly of claim 15, wherein:

said cord drive component corresponds to a first cord drive component; and said cord drive assembly further comprises a second cord drive component configured to rotate relative to said first cord drive component when said first cord drive component is located at the first position such that a portion of said second cord drive component contacts a corresponding portion of said first cord drive component to push said first cord drive component axially from the first position to the second position.

17. The cord drive assembly of claim 15, wherein said cantilevered arm is configured to at least partially hinder rotation of said first cord drive component when said first cord drive component is located at the first position and said second cord drive component is rotating relative to said first cord drive component.

18. The cord drive assembly of claim 15, wherein said cantilevered arm is formed by a portion of said housing that is biased towards and into engagement with said cord drive component.

19. The cord drive assembly of claim 18, wherein at least a portion of the braking force comprises a spring force provided by said cantilevered arm independent of the biasing force applied by said spring in the braking direction.

20. The cord drive assembly of claim 15, wherein said spring includes a first portion positioned and configured to engage said cantilevered arm and a second portion positioned and configured to engage a portion of said housing separate from said cantilevered arm.

21. The cord drive assembly of claim 20, wherein said first portion of said spring engages said cantilevered arm along the exterior of said housing and said second portion of said spring engages said portion of said housing within the interior of said housing.

22. A cord drive assembly for raising a covering relative to an architectural structure, said cord drive comprising:

a housing including a housing wall defining an outer surface extending along an exterior of said housing and an inner surface extending within an interior of said housing, said housing including a cantilevered arm positioned relative to said housing wall such that an outer side of said cantilevered arm is positioned along the exterior of said housing and an inner side of said cantilevered arm is positioned along the interior of said housing;

a cord drive component mounted for rotation within said housing; and a spring positioned and configured to engage said cantilevered arm, said spring including a first portion positioned and configured to engage said cantilevered arm and a second portion positioned and configured to engage a portion of said housing separate from said cantilevered arm;

wherein:

said cantilevered arm applies a braking force against said cord drive component in a braking direction to at least partially hinder rotation of said cord drive component within said housing;

said spring applies a biasing force against said cantilevered arm in the braking direction, the biasing force biasing said cantilevered arm against said cord drive component; and said first portion of said spring engages said cantilevered arm along the exterior of said housing and said second portion of said spring engages said portion of said housing within the interior of said housing.

23. The cord drive assembly of claim 22, wherein:

said cord drive component is movable axially within said housing relative to an output member of said cord drive assembly between a first position and a second position;

said cord drive component is rotationally decoupled from said output member when said cord drive component is moved to the first position; and said cord drive component is rotationally coupled to said output member when said cord drive component is moved to the second position.

24. The cord drive assembly of claim 23, wherein:

said cord drive component corresponds to a first cord drive component; and said cord drive assembly further comprises a second cord drive component configured to rotate relative to said first cord drive component when said first cord drive component is located at the first position such that a portion of said second cord drive component contacts a corresponding portion of said first cord drive component to push said first cord drive component axially from the first position to the second position.

* * * * *